United States Patent [19]

Stoll

[11] 3,984,964

[45] Oct. 12, 1976

[54] BOTTLE PACKING SYSTEM

[75] Inventor: Paul Stoll, Etobicoke, Canada

[73] Assignee: Bristol-Myers Canada Limited, Toronto, Canada

[22] Filed: Sept. 15, 1975

[21] Appl. No.: 613,606

[52] U.S. Cl. ..... 53/161; 53/247; 214/1 BD; 294/67 B; 294/87 R

[51] Int. Cl.[2] ..... B65B 21/06; B65B 35/40

[58] Field of Search ..... 53/61, 161, 164, 166, 53/243, 247, 248; 294/67 R, 67 B, 87 R; 214/1 BD

[56] References Cited

UNITED STATES PATENTS

| | | | |
|---|---|---|---|
| 2,709,029 | 5/1955 | Cox et al. | 53/247 X |
| 3,438,515 | 4/1969 | Nowicki | 214/1 BD |
| 3,702,524 | 11/1972 | Johnson et al. | 53/161 X |
| 3,826,382 | 7/1974 | Zappia | 53/161 X |
| 3,834,117 | 9/1974 | Gift | 294/87 R |
| 3,908,812 | 9/1975 | Graff | 53/159 X |
| 3,914,921 | 10/1975 | Doran et al. | 53/247 X |
| D137,810 | 5/1944 | Jackson | 294/87 R |

*Primary Examiner*—Robert Louis Spruill
*Attorney, Agent, or Firm*—David J. Mugford; George A. Mentis; Samuel J. DuBoff

[57] ABSTRACT

A bottle packing system including an oscillating grid for transferring bottle groups from a grouping station to a carton-filling station, the grid including tensioned resilient means for engaging and retaining bottles in the grid during its oscillation, and a positive-ejection member rockable into the grid for ejecting the bottles from the grid at the carton-filling station.

14 Claims, 6 Drawing Figures

BOTTLE PACKING SYSTEM

BACKGROUND OF THE INVENTION

The present invention relates to the loading of cases or cartons and is concerned, more particularly, with the feeding, orientation, grouping and loading of vessels or bottles into cartons.

BRIEF DISCUSSION OF THE PRIOR ART

The packing or loading of bottles and the like onto cardboard cartons has been the subject of a considerable amount of study and development effort and has achieved a reasonable degree of sophistication.

However, in achieving this sophistication, prior bottle packers have also become increasingly more complex, more costly and more prone to operational errors or malfunctions and to higher maintenance costs.

Typically, these systems include means for feeding, orienting and then grouping the bottles and means for associating the pre-grouped bottles within their carton. Bottles are more stable and manageable in their upright position, in which they rest on their base, than in an inverted position. Therefore, the conveying, orienting and grouping of such bottles is far more simply accomplished with the bottles upright. This manner of handling is widely used in prior systems.

It is in the step of associating the grouped bottles within their cartons that particularly disadvantageous complexities have persisted. Whether the bottle group is moved toward the carton or the carton is moved toward the bottle group, or both, it is necessary that the grouping of the bottles is first accurately established and thereafter accurately maintained until the bottles are sufficiently confined within their carton that the limited space of the carton ensures the retention of the proper grouping of the bottles therein.

In these systems, the means for maintaining the proper grouping of the bottles have included grasping elements which are mechanical or pneumatic in nature. These grasping elements have engaged the necks of the bottles, the sides, or the bottoms, or even more than one portion of such bottles but, more significantly, have requires the use of relatively complicated and delicate structures, electromechanical or electropneumatic controls and the like, to provide for proper sequencing or synchronization of the gripping elements with other steps in the system.

Such systems are prone to maladjustment and breakage and, therefore, malfunctioning of the system, including non-retention of the bottles, at one extreme, or damaging of the bottles at the other extreme.

These problems are particularly significant in systems in which bottles are aligned or grouped in their upright position and then rocked or rotated into an inverted position for insertion into a carton. Especially when groups of bottles are to be handled, the need for gripping members to move first adjacent to the bottles and then laterally into gripping contact therewith, the orientation and or grouping steps are themselves made more complex by the need to accommodate the presence and operation of the gripping system.

SUMMARY OF THE INVENTION

In general, the preferred form of the present invention comprises a bottle packing station including a frame which oscillates on a horizontal axis, means for presenting a bottle to said frame at a first of its extreme positions of oscillation, frictional means for retaining said bottle in said frame, and positive-ejection means for overcoming the frictional means at the second extreme of oscillation of the frame to discharge the bottle from the frame at said second extreme position.

Preferably, the first and second extreme positions of oscillation are generally horizontally aligned and the positive-ejection means oscillates on an axis parallel to and offset from the axis of oscillation of the frame.

OBJECTS OF THE INVENTION

It is an object of the present invention to provide a simple and reliable system for packing vessels into their containers.

It is a further object of the present invention to provide a simple and reliable system for receiving, orienting and packaging groups of bottles into a single carton.

It is another object of the present invention to provide a simple reliable system for receiving, orienting, and grouping multiple bottles in a first position and rocking the bottle groups to a second position without selectively-actuable gripping of the bottles.

It is a still further object of the present invention to provide a system for rocking a bottle into position for receipt by a carton without selectively-actuable gripping thereof and with positive ejection of the bottle into the carton.

Another object of the present invention is the provision of a simple and reliable system for orienting a bottle for frictional engagement and retention by an oscillating frame at a first position, rocking the frame and the retained bottle to a second position for receipt by a carton, and positively ejecting the bottle from the frame into the carton.

Another object of the present invention is the provision of a system for packing groups of bottles into a carton by orienting and grouping bottles at a first station, engaging and retaining the bottles frictionally in frames, rocking the frames on a generally horizontal axis to a second position at which the bottles are at least partially entered within a carton, and rocking a positive ejection member into engagement with and displacing the bottles into the carton.

It is a more particular object of the invention to provide a system for orienting rows of bottles, grouping plural rows of bottles, engaging and retaining the group of bottles frictionally in a grid of individual frames, rocking the grid on a generally horizontal axis to a position above a carton, and rocking an ejector on a parallel axis to present an ejection member into each frame to positively eject the bottles downwardly into the carton.

Another particular object of the present invention is the provision of a frame for the accomplishment of the foregoing objects and which includes a tensioned resilient member positioned for engagment and retention of a bottle entered therein.

BRIEF DESCRIPTION OF THE DRAWINGS

These and other objects of the present invention and a better understanding thereof may be derived from the following description and the accompanying drawings, in which.

DETAILED DESCRIPTION OF THE PREFERRED EMBODIMENT

Figure 1:
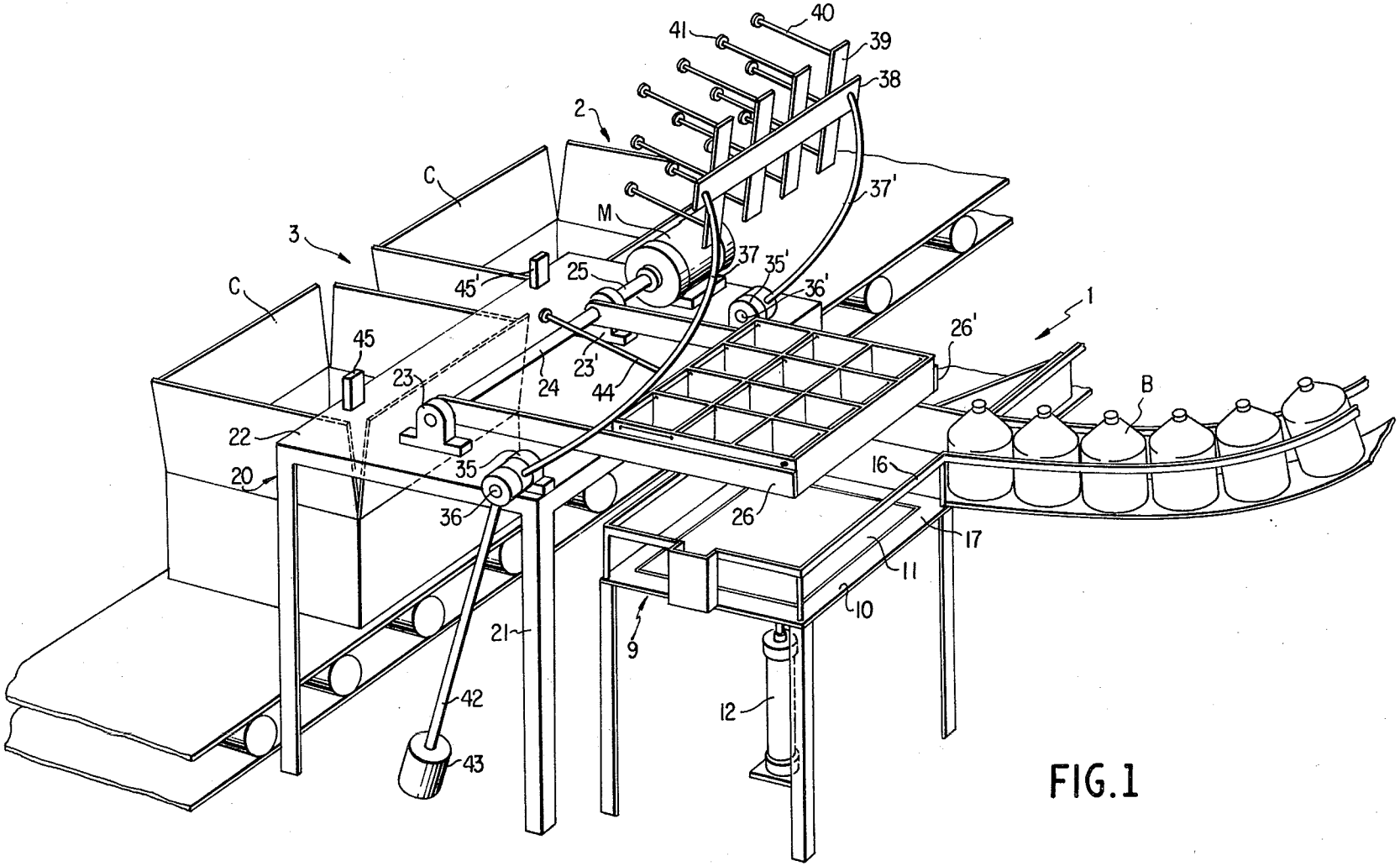
FIG. 1 is a perspective view of a preferred form of bottle packer according to the invention.

As shownn in the drawings, the preferred form of bottle packer of the preferred invention comprises an orienting and grouping station 1, a transfer station 2, and a carton-filling station 3.

Figure 2:
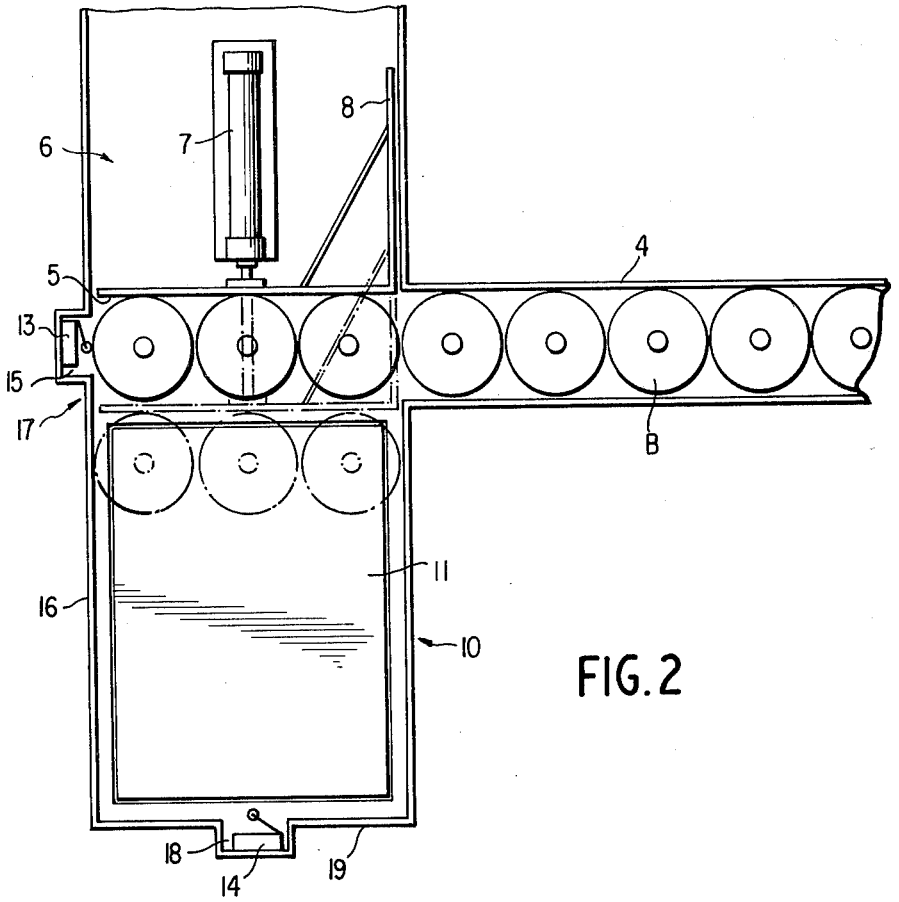
FIG. 2 is a schematic plan view of the orienting and grouping station.
Figure 3:
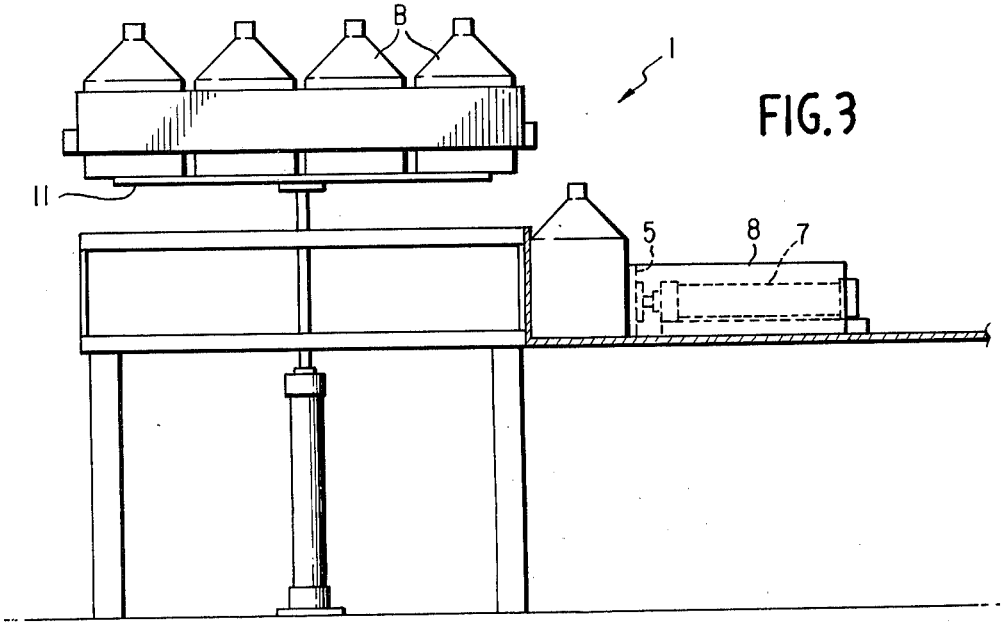
FIG. 3 is an end view of the station shown in FIG. 2.

The orienting and grouping station 1 receives bottles B from the gravity chute 4 and, as best shown in FIG. 2, accumulates them oriented in rows of 3 adjacent the forward wall or face 5 of a pusher 6 which includes a ram 7 and a cut-off wall 8 abutting and perpendicular to the wall 5.

While the preferred system is disclosed herein as orienting bottles in rows of 3 and grouping four such rows, it is to be understood that the invention is applicable to any desired number of bottles, depending upon the size of the bottles in relation to the carton size. Also, it should be understood that the invention is quite capable of modification for the loading of more than one carton at a time, although single-carton loading is disclosed for simplicity.

As best shown in FIG. 1, the station 1 includes a flat table 9 having a fixed portion 10, aligned with the chute and along the face 5 of the pusher, and an elevator secton 11 toward which the pusher advances, as shown in dotted lines in FIG. 2. The elevator section 11 is supported on any suitable lifting means such as the pneumatic cylinder 12 shown.

On its upper surface, the station 1 is provided with an orienting sensor 13 and a grouping sensor 14 both positioned to be engaged by bottles. The orienting sensor 13 is positioned in a recess 15 in its edge fence 16, adjacent the pusher face 5 to signal that a sufficient number of bottles have entered the area 17 in front of the pusher face. The grouping sensor 14 is positioned in a recess 18 in the fence 16 at the edge 19 opposite the pusher face to signal the filling of the elevator section 11 with an adequate group of oriented rows, as will be discussed more fully hereinafter. The table 9 and chute 4 are provided with suitable fencing 16 for retaining the bottles thereon.

The transferring station 2 includes a frame 20 having legs 21 and an upper surface 22 carrying a pair of bearing blocks 23 and 23' in which is mounted an axle 24 suitably coupled to the shaft 25 of a motor M.

The axle 24 has a pair of spaced, parallel arms 26 and 26' suitably secured thereon and carrying a grid 27 rigidly mounted between their distal ends and, as shown in FIG. 1, overlying the elevator section 11 of station 1.

Figure 4:
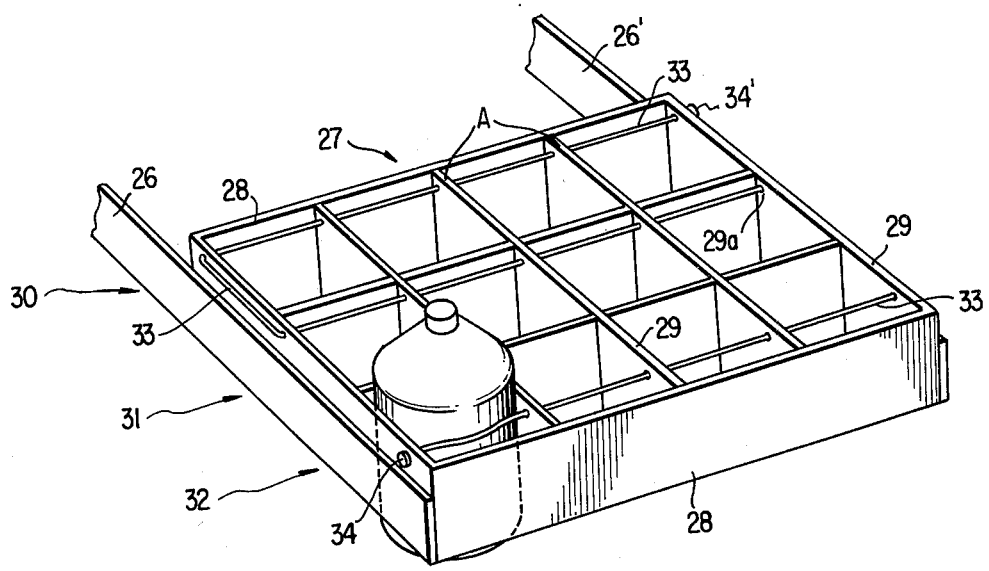
FIG. 4 is a perspective view, on an enlarged scale, of the bottle-transferring grid.

As best shown in FIG. 4, the grid 27 is formed of a plurality of spaced longitudinal members 28 and spaced transverse members 29 which are positioned to form a plurality of apertures "A" in three courses 30, 31 and 32 and equal in total number to the proper member of bottles in the underlying group upon the elevator section 11.

The transverse members 29 carry a taught, resilient cord 33 serially threaded through the courses 30, 31 and 32 be means of aligned series of apertures **29*a*. The apertures 29*a* are spaced inwardly from their adjacent longitudinal members 28 sufficiently to intersect the outline or body of a bottle entered in an aperture, as shown by the distortion of the cord by the sole bottle shown in FIG. 4**. The remaining bottles of the full group have not been shown in order to avoid obscuring the grid structure in that Figure.

The cord 33 is mounted by suitable means such as the clamps 34' and 34 and is tensioned therebetween at least sufficiently to remove any slack along its length.

The cord 33 preferably has a substantial frictional coefficient, in addition to being moderately resilient, so that it will securely retain bottles trapped in the cells against gravitational and inertial forces tending to release the bottles. Synthetic cordage has been found to be quite effective, in this service, and nylon cord has been found to be particularly advantageous.

The transfer station surface 22 of frame 20 carries a pair of bearings 35, 35' positioned to define an axis parallel to the axle 24 and laterally offset therefrom. The bearings 35, 35' mount stub axles 36 and 36' upon which are respectively mounted a pair of arms 37 and 37'.

The arms 37 and 37'are positioned, with respect to each other, by a longitudinal plate 38 and form therewith a hoop structure through which the transfer grid is freely rockable.

The longitudinal plate 38 carries a plurality of transverse arms 39 equal in number to the number of transverse rows of bottle-receiving apertures in the transfer grid 27. The transverse arms 39 each carry a plurality of rods 40 carrying terminal pads 41 and equal in number to the number of apertures in each of the transverse rows.

The pattern or positioning of the rods 40 and pads 41, therefore, is such that each is alignable with one of the aperture A in the grid 27 to form a positive ejection structure, as will be discussed more fully hereinafter. The stub axle 36 is extended through the bearing 35 to carry an arm 42 secured thereon which carries a counterweight 43 generally diametrically opposite the structure mounted on the longitudinal plate 38.

Figure 6:
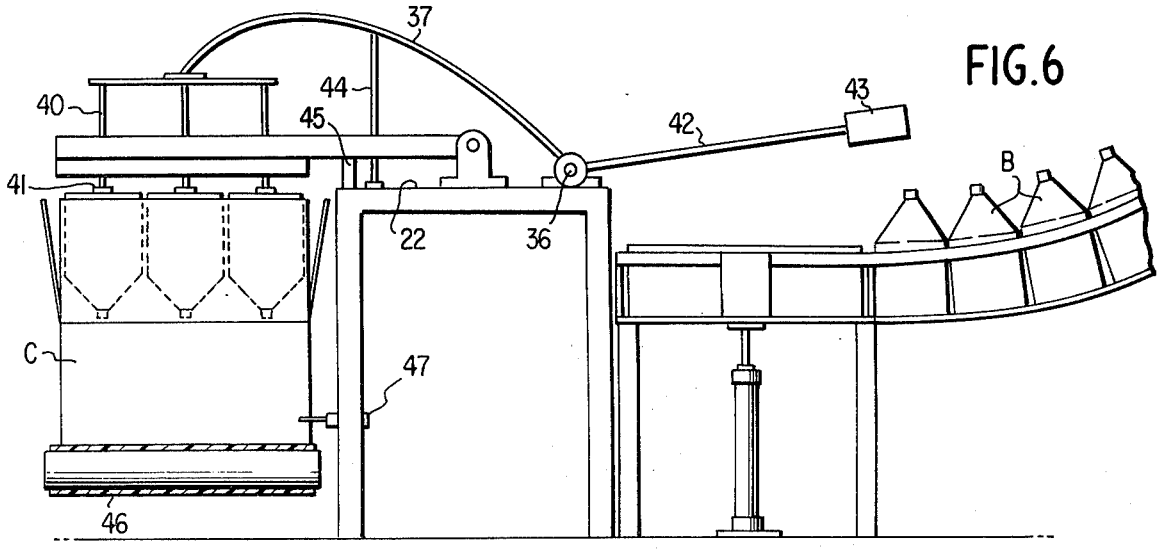
FIG. 6 is a view similar to FIG. 5 and showing the bottles removed from the transferring grid by the ejector.

The arm 37 carries a stop arm 44, as best shown in FIG. 6, for limiting the degree of rotation of the ejection assembly. However, it is to be understood that other suitable stop means may be employed. Corresponding stops 45, 45' are provided on the surface 22 for limiting the opposite extremes of oscillation of the transfer arms 26, 26', respectively.

The carton-filling station 3 includes a conveyor 46 for presenting empty cartons C to the loading position which may be defined, for example, by any suitable means such as a sensor 47.

The bottle packing installation will be provided with a control system of any type compatible with the service and with the surrounding facilities. The particular form of control system is not important to the present invention and, therefore, such a system has not been described in detail, since such systems are well known to those skilled in the art.

OPERATION OF THE PREFERRED EMBODIMENT

In operation, bottles are supplied to the chute 4 by any suitable means (not shown) and pass in sequence therealong to enter on the fixed area 17 of the table 9. When the fixed area is filled with the proper number of bottles, the side of the first-entered bottle triggers the sensor 13, as represented in solid lines in FIG. 2.

The pusher assembly 6 is then actuated to advance the bottles to the position shown in dotted lines in FIG. 2. During reciprocation of the pusher assembly, the cut-off wall 8 prevents the entrance of further bottles onto the fixed area 17, until the pusher face 5 has retracted to the solid-line position of FIG. 2.

The cycle is repeated, adding aligned rows of bottles onto the elevator area 11 until the proper number of rows have been entered thereon and signalled by contact of a bottle with the sensor 14. Actuation of the pusher 6 is then stopped, and the elevator raises the grouped bottles to wedge the individual bottles into the apertures A of the overlying grid 27.

Within the apertures A, the bottles B engage and distort the cord 33, thereby increasing its tension and adding to its frictional engagement against the bottle walls. The elevator section 11 is then retracted to its original position, with the bottles being securely retained in the grid 27.

Figure 5:
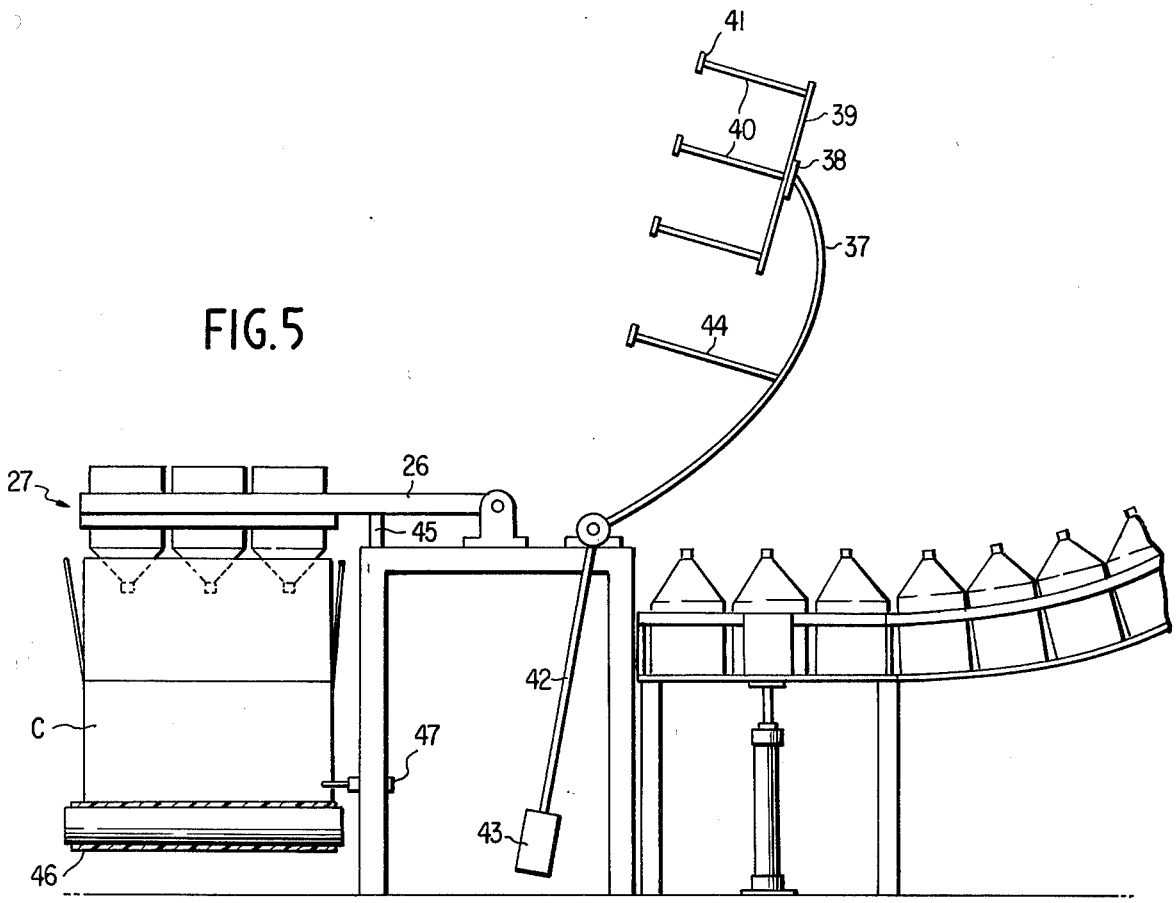
FIG. 5 is a side elevation showing the transferring grid in position over the carton.

The grid 27 is then oscillated or rocked on its axle 24 to stop just above the edge of the opened carton C, as limited by the block 45 engaging the arm 26, as shown in FIG. 5, with a significant portion of the bottles entered into the carton.

The positive ejection assembly is then rocked over to the position shown in FIG. 6, with the pads 41 of rods 40 engaging the bottoms of the bottles and progressively ejecting the bottles from the apertures until they are aligned within the carton walls and then clear the engagement with the cord 33 to drop a short distance to the carton bottom.

The ejection assembly is then retracted to the position shown in FIG. 1 and the grid 27 is then similarly retracted in preparation for another packing cycle.

It should be noted that the provision of the ejection assembly as a hoop rotatable on an axis parallel and adjacent the axle 24 enhances the compactness of the system. The resultant greater length of the arms 37 provides clearance for the grid 27 to pass therethrough, while the offset axis of the ejector assembly permits proper positioning of the rods and pads 41 against the bottles at the carton-filling station. It is to be understood, however, that other articulations of the ejector assembly may be employed, if desired.

Therefore, it is apparent that the present invention provides a particularly advantageous bottle packing system of unusual simplicity and reliability and with a minimum of complexity of structure required for the transfer of the bottles from their grouping point to their packing point.

While a rocking or oscillation of the grid through 180° is preferred, between horizontally-aligned positions for receiving and discharging bottle groups, it is to be understood that this extent of oscillation may be varied, if desired or if advantageous regarding the site and accessory equipment.

Various other modifications may be made in the invention, as disclosed, without sacrificing the advantages thereof or departing from the scope of the appended claims.

I claim:

1. A bottle packing system including:

A. a frame having at least one bottle-receiving aperture therein:

B. resilient means in said aperture for retaining a bottle in said aperture;

C. means mounting said frame for oscillation about an axis between a first bottle-receiving position and a second bottle-ejection position;

D. ejection means including an ejector member for ejecting the bottle from the aperture at said second position, wherein said ejection means includes a hoop member carrying said ejector member, means mounting said hoop member for oscillation on an axis parallel to and offset from the axis of oscillation of said frame; and E. bottle insertion means for inserting a bottle into said aperture.

2. A bottle packing system according to claim 1 in which said resilient means includes a cord mounted under tension across a portion of said aperture.

3. A bottle packing system according to claim 2 in which said cord is a synthetic rope.

4. A bottle packing system according to claim 3 in which said cord is a nylon rope.

5. A bottle packing system according to claim 2 in which said frame includes a selected number of apertures in a grid pattern and means for orienting and grouping a corresponding number of bottles in said pattern at said first position of said frame.

6. A bottle packing system according to claim 5 in which said pattern includes a series of rows, and said orienting and grouping means includes reciprocating pusher means for advancing rows of bottles toward said first position of said frame.

7. A bottle packing system according to claim 6 including means for feeding bottles laterally to said pusher means, and a lateral wall on said pusher means and positioned to obstruct said feeding means during reciprocation of said pusher means.

8. A bottle packing system according to claim 6 wherein said bottle insertion means includes an elevator below the first position of said frame and positioned to receive bottles in said pattern from said pusher means.

9. A bottle packing system according to claim 6 in which said ejector member includes a plurality of ejector rods positioned in said pattern, said ejector member is mounted on a hoop member, and means mounting said hoop for oscillation on an axis parallel to the axis of oscillation of said frame and laterally offset therefrom toward the first position of said frame a distance sufficient to permit positioning said ejector rods in said apertures at the second position of said frames.

10. A bottle packing system according to claim 9 in which said first and second positions of said frame are generally horizontally aligned with each other on opposite sides of their axis of oscillation.

11. A bottle packing system according to claim 10 wherein said bottle insertion means includes an elevator below the first position of said frame and positioned to receive bottles in said pattern from said pusher means.

12. A bottle packer according to claim 11 including means for positioning a carton below the second position of said frame.

13. A bottle packing system according to claim 1 in which the axis of oscillation of said hoop member is offset toward the first position of said frame.

14. A bottle packing system according to claim 13 in which said hoop member carries and opposing counterweight.

* * * * *